US009849674B2

(12) United States Patent
Cattaneo et al.

(10) Patent No.: US 9,849,674 B2
(45) Date of Patent: Dec. 26, 2017

(54) MANUFACTURING METHOD FOR A FLUID-EJECTION DEVICE, AND FLUID-EJECTION DEVICE

(71) Applicant: STMICROELECTRONICS S.R.L., Agrate Brianza (IT)

(72) Inventors: Mauro Cattaneo, Sedriano (IT); Carlo Luigi Prelini, Seveso (IT); Lorenzo Colombo, Besana in Brianza (IT); Dino Faralli, Milan (IT); Alessandra Sciutti, Concorezzo (IT); Lorenzo Tentori, Verano Brianza (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 15/179,096

(22) Filed: Jun. 10, 2016

(65) Prior Publication Data

US 2017/0182778 A1 Jun. 29, 2017

(30) Foreign Application Priority Data

Dec. 29, 2015 (IT) ..... 102015000088567

(51) Int. Cl.

| | |
|---|---|
| ***B41J 2/16*** | (2006.01) |
| ***B41J 2/135*** | (2006.01) |
| ***B41J 2/01*** | (2006.01) |

(52) U.S. Cl.

CPC ..... *B41J 2/1626* (2013.01); *B41J 2/01* (2013.01); *B41J 2/135* (2013.01); *B41J 2/16* (2013.01); *B41J 2/162* (2013.01); *B41J 2/1607* (2013.01); *B41J 2/1621* (2013.01); *B41J 2/1628* (2013.01); *B41J 2/1629* (2013.01); *Y10T 29/49401* (2015.01)

(58) Field of Classification Search

None

See application file for complete search history.

(56) References Cited

U.S. PATENT DOCUMENTS

2013/0284694 A1* 10/2013 Cai ..... B41J 2/14032 216/27

2014/0313264 A1 10/2014 Cattaneo et al.

FOREIGN PATENT DOCUMENTS

WO 2005/021269 A1 3/2005

* cited by examiner

*Primary Examiner* — Jiong-Ping Lu

(74) *Attorney, Agent, or Firm* — Seed IP Law Group LLP

(57) ABSTRACT

A method for manufacturing a device for ejecting a fluid, including producing a nozzle plate including: forming a first nozzle cavity, having a first diameter, in a first semiconductor body; forming a hydrophilic layer at least in part in the first nozzle cavity; forming a structural layer on the hydrophilic layer; etching the structural layer to form a second nozzle cavity aligned to the first nozzle cavity in a fluid-ejection direction and having a second diameter larger than the first diameter; proceeding with etching of the structural layer for removing portions thereof in the first nozzle cavity, to reach the hydrophilic layer and arranged in fluid communication the first and second nozzle cavities; and coupling the nozzle plate with a chamber for containing the fluid.

22 Claims, 7 Drawing Sheets

MANUFACTURING METHOD FOR A FLUID-EJECTION DEVICE, AND FLUID-EJECTION DEVICE

BACKGROUND

Technical Field

The present disclosure relates to a manufacturing method for a fluid-ejection device and to a fluid-ejection device. In particular, the present disclosure regards a process for manufacturing a fluid-ejection head based upon piezoelectric technology, and to a fluid-ejection head that operates using piezoelectric technology.

Detailed Description

Known to the prior art are multiple types of fluid-ejection devices, in particular ink-jet heads for printing applications. Similar heads, with appropriate modifications, may likewise be used for ejection of fluids other than ink, for example for applications in the biological or biomedical field, for local application of biological material (e.g., DNA) in the manufacture of sensors for biological analyses, for the decoration of fabrics or ceramics, and in applications of 3D printing and additive manufacturing.

Known manufacturing methods envisage coupling via gluing or bonding of a large number of pre-processed parts. This process proves costly and calls for high precision, and the resulting device has a large thickness.

To overcome these drawbacks, the document No. US 2014/0313264 discloses a manufacturing method for a fluid-ejection device completely obtained on a silicon substrate with technologies typical of manufacture of semiconductor devices and formed by coupling together just three wafers. According to this process, however, manufacture of the nozzle is obtained following upon coupling of the wafer bearing the nozzle to the other wafers, already coupled together. The consequence of this is a limited freedom of action on the stack thus formed, in part on account of the machines used for handling a stack of coupled wafers, and in part on account of the technological processes, which are not compatible with the adhesive material used for coupling the three wafers (e.g., high-temperature processes or processes involving use of some types of solvents). Furthermore, formation of an anti-wetting coating around the nozzle proves inconvenient.

BRIEF SUMMARY

At least some embodiments of the present disclosure provide a manufacturing method for a fluid-ejection device, and a fluid-ejection device that overcome at least some of the drawbacks of the known art.

According to the present disclosure a manufacturing method for a fluid-ejection device and a fluid-ejection device are provided.

BRIEF DESCRIPTION OF THE SEVERAL VIEWS OF THE DRAWINGS

For a better understanding of the present disclosure, preferred embodiments thereof are now described, purely by way of non-limiting example, with reference to the attached drawings, wherein.

DETAILED DESCRIPTION

Figure 1:
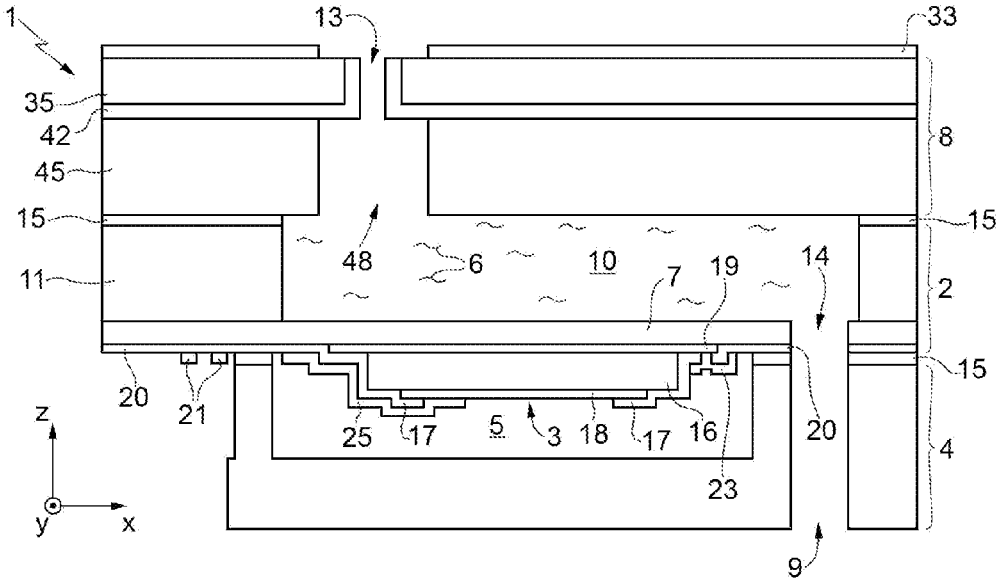
FIG. 1 shows, in lateral section, a fluid-ejection device provided according to a method forming the subject of the present disclosure.

Fluid-ejection devices based upon piezoelectric technology may be manufactured by bonding, or gluing, together a plurality of wafers previously processed employing micromachining technologies typically used for producing MEMS (Micro-Electro-Mechanical Systems) devices. In particular, with reference to FIG. 1, a liquid-ejection device 1 is illustrated according to an aspect of the present disclosure. With reference to FIG. 1, a first wafer 2, including a substrate 11, is processed for forming thereon one or more piezoelectric actuators 3, designed to be driven for generating a deflection of a membrane 7 that extends partially suspended over one or more chambers 10, which are designed to define respective reservoirs for containing fluid 6 to be expelled during use. A second wafer 4 is processed for forming one or more chambers 5 for containing the piezoelectric actuators 3, such as to isolate, in use, the piezoelectric actuators 3 from the fluid 6 to be expelled, and for forming one or more inlet holes 9 for the fluid 6, in fluidic connection with the chambers 10. A third wafer 8 is processed to form holes 13 for ejection of the fluid 6 (nozzles) in a body made, for example, of polysilicon (designated by the references 35 and 45), which is provided with a hydrophilic region 42 (e.g., of $SiO_2$).

Then, the aforementioned wafers 2, 4, 8 are assembled together via soldering interface regions, and/or bonding regions, and/or gluing regions, and/or adhesive regions, for example of polymeric material, designated as a whole by the reference number 15 in FIG. 1.

The piezoelectric actuators 3 comprise a piezoelectric region 16 arranged between a top electrode 18 and a bottom electrode 19, which are designed to supply an electrical signal to the piezoelectric region 16 for generating, in use, a deflection of the piezoelectric region 16 that consequently causes a deflection of the membrane 7 in a per se known manner. Metal paths (designated as a whole by the reference 20) extend from the top electrode 18 and the bottom electrode 19 towards an electrical contact region, provided with contact pads 21 designed to be biased through bonding wires (not illustrated).

With reference to FIGS. 2-12, there now follows a description of a process for manufacturing the fluid-ejection device 1 according to an embodiment of the present disclosure.

Figure 2:
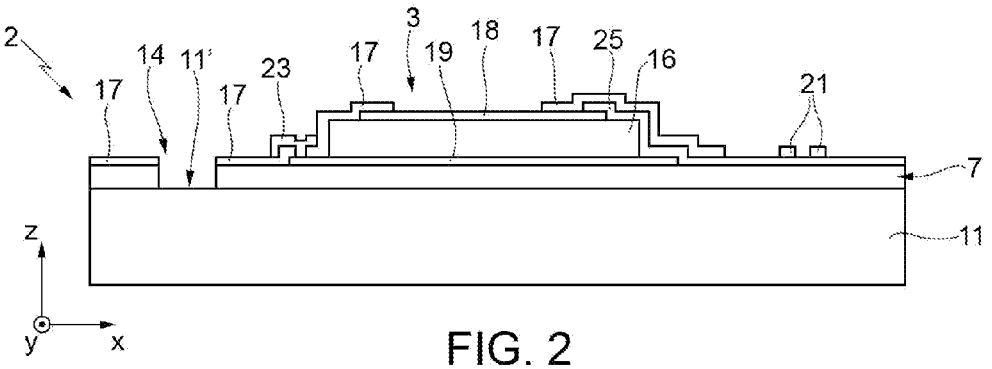
FIGS. 2-12 show steps for manufacturing the fluid-ejection device of FIG. 1, according to an embodiment of the present disclosure.
Figure 3:
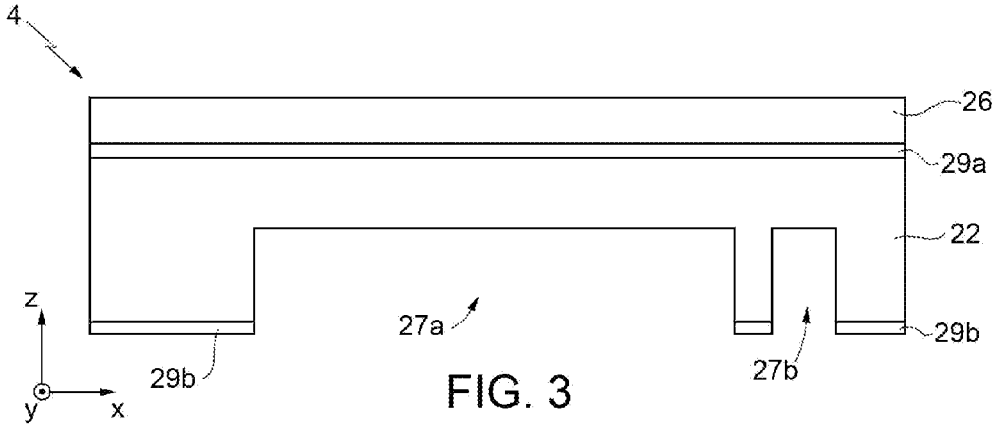
Figure 4:
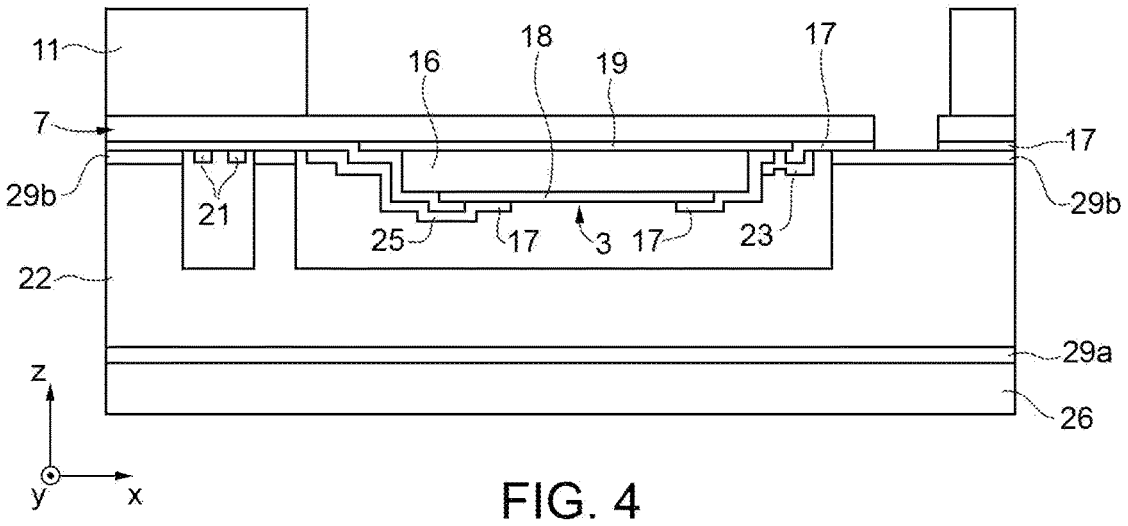

In particular, FIGS. 2-4 describe steps for micromachining the first and second wafers 2, 4; FIGS. 5-12 describe steps for micromachining the third wafer 8.

In particular, with reference to FIG. 2, the steps for manufacturing the first wafer 2 envisage, in brief, first of all providing the substrate 11 of semiconductor material (e.g., silicon). Then, a membrane layer 7 is formed on this substrate, for example including a $SiO_2$-polysilicon-$SiO_2$ stack, where the $SiO_2$ layers have a thickness, for example, comprised between 0.1 and 2 μm, and the polysilicon layer (grown epitaxially) has a thickness comprised between 1 and 20 μm. In different embodiments, the membrane may be of other materials typically used for MEMS devices, for example $SiO_2$ or else SiN, having a thickness comprised between 0.5 and 10 μm, or else by a stack in various combinations of $SiO_2$—Si—SiN.

The next step is formation, on the membrane layer 7, of the bottom electrode 19 of the piezoelectric actuator 3 (formed, for example, by a $TiO_2$ layer having a thickness comprised between 5 and 50 nm, deposited on which is a Pt layer having a thickness comprised between 30 and 300 nm).

This is followed by deposition of a piezoelectric layer on the bottom electrode 19, depositing a layer of PZT (Pb, Zr, $TiO_3$), having a thickness comprised between 0.5 and 3.0 μm, more typically 1 or 2 μm (which will form, after subsequent definition steps, the piezoelectric region 16). Next, deposited on the piezoelectric layer is a second layer of conductive material, for example Pt or Ir or $IrO_2$ or TiW or Ru, having a thickness comprised between 30 and 300 nm, for forming the top electrode 18.

The electrode and piezoelectric layers are subjected to lithographic and etching steps in order to pattern them according to a desired pattern thus forming the bottom electrode 19, the piezoelectric region 16, and the top electrode 18.

One or more passivation layers 17 are then deposited on the bottom electrode 19, the piezoelectric region 16, and the top electrode 18. The passivation layers include dielectric materials used for electrical insulation of the electrodes, for example, $SiO_2$ or SiN or $Al_2O_3$ layers whether single or stacked on top of one another, having a thickness comprised between 10 nm and 1000 nm. The passivation layers are then etched in selective regions to create access trenches towards the bottom electrode 19 and the top electrode 18. This is then followed by a step of deposition of conductive material, such as metal (e.g., aluminum or else gold, possibly together with barrier and bonding layers such as Ti, TiN, TiW or Ta, TaN), inside the trenches thus created and on the passivation layers 17. A subsequent patterning step enables formation of conductive paths 23, 25 that enable selective access to the top electrode 18 and to the bottom electrode 19 to enable electrical biasing thereof in use. It is further possible to form further passivation layers (e.g., $SiO_2$ or SiN layers, not illustrated) for protecting the conductive paths 23, 25. Conductive pads 21 are likewise formed alongside the piezoelectric actuator, electrically coupled to the conductive paths 23, 25.

Finally, the membrane layer 7 is selectively etched in a region thereof that extends alongside, and at a distance from, the piezoelectric actuator 3 for exposing a surface region 11' of the underlying substrate 11. A through hole 14 is thus formed through the membrane layer 7, which enables, in subsequent manufacturing steps, formation of a fluid path on the outside of the fluid-ejection device 1 towards the reservoir 10, through the inlet hole 9, as illustrated in FIG. 1.

With reference to the second wafer 4, illustrated in FIG. 3, the manufacturing steps envisage providing a substrate 22 of semiconductor material (e.g., silicon) that has a thickness of, for example, 400 μm, and is provided with one or more dielectric layers 29*a*, 29*b* (e.g., $SiO_2$ or SiN layers or their combinations) on both sides. Deposited on a top face of the second wafer 4, on the dielectric layer 29*a*, is a structural polysilicon layer 26, with a thickness comprised between 1 and 20 μm, for example 4 μm.

Then, processing steps are carried out on the bottom face, opposite to the top face of the second wafer 4. In particular, the second wafer 4 is etched in the region where the inlet hole 9 is to be formed by removing selective portions of the dielectric layer 29*b* and of the substrate 22 throughout the thickness thereof and digging a deep trench (with etch stop on the dielectric layer 29*a*).

By a further step of etching of the bottom face of the second wafer 4 there are formed a recess 27*a*, which, in subsequent steps, will form the containment chamber 5, and a recess 27*b*, which, in subsequent steps, will be arranged facing the region of the first wafer 2 that houses the conductive pads 21. According to one aspect of the present disclosure, the recesses 27*a*, 27*b* thus formed have a depth, along Z, comprised between 50 and 300 μm.

The first and second wafers 2, 4 thus produced are then coupled together (e.g., by the wafer-to-wafer bonding technique, as illustrated in FIG. 4) so that the containment chamber 5 will contain completely the piezoelectric actuator 3 and so that the through hole 14 made through the membrane 7 will be aligned, and in fluidic connection, with the inlet hole 9 made through the substrate 22 of the second wafer 4. A stack of wafers is thus obtained.

The substrate 11 of the wafer 2 is then etched for forming a cavity on the side opposite to the side that houses the piezoelectric actuator 3, through which the silicon-oxide layer that forms the membrane 7 is exposed. This step enables release of the membrane 7, making it suspended.

There now follows a description, according to one aspect of the present disclosure, of steps of processing of the third wafer 8.

Figure 5A:
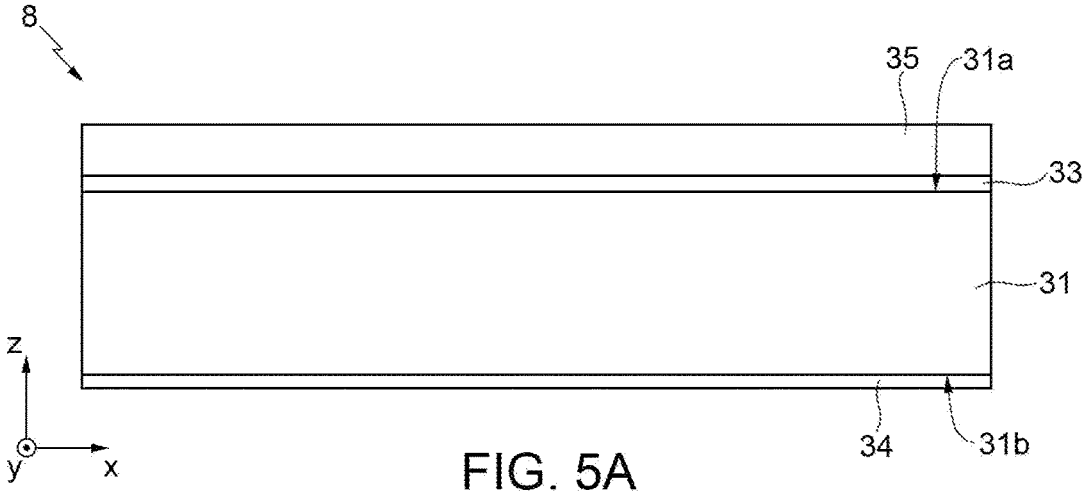

With reference to FIG. 5A, the third wafer 8 is provided, including a substrate 31, for example having a thickness comprised between approximately 400 and 800 μm, in particular approximately 600 μm. The substrate 31 is made, according to one embodiment of the present disclosure, of semiconductor material, such as silicon. The substrate 31 has a first surface 31*a* and a second surface 31*b*, opposite to one another in a direction Z. Formed by thermal oxidation on the first surface 31*a* is a first interface layer 33, of silicon oxide ($SiO_2$). The step of thermal oxidation typically involves formation of an oxide layer 34 also on the back of the substrate 31, on the second surface 31*b*. The first interface layer 33 (and, likewise, the back oxide layer 34) has, for example, a thickness comprised between approximately 0.2 μm and 2 μm.

Figure 5B:
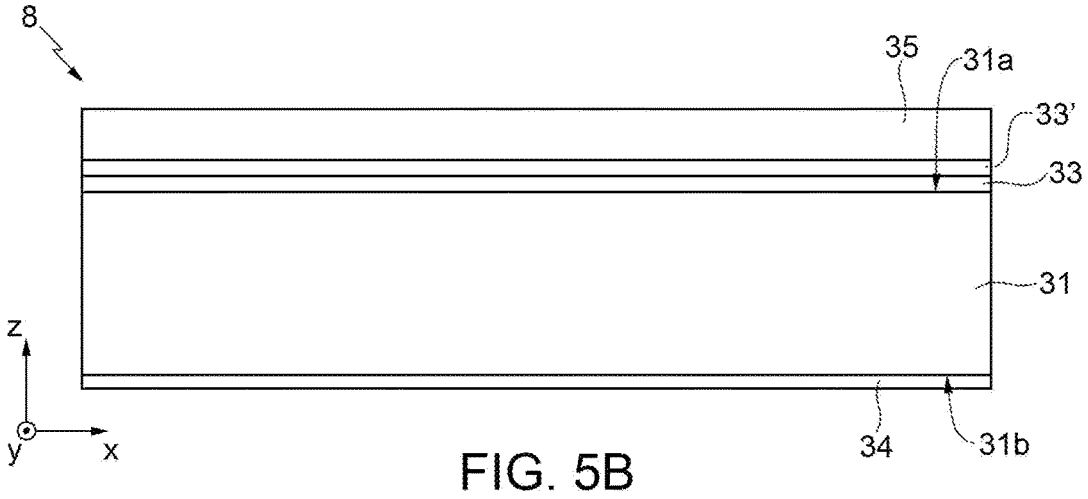

According to a further embodiment of the present disclosure, illustrated in FIG. 5B, it is possible to form on the interface layer 33 (or as an alternative thereto) one or more further anti-wetting layers 33', which have hydrophobic characteristics, i.e., they designed to bestow anti-wetting functions on the nozzle 13 subsequently produced. Said layers are of materials typically formed by silicon, in compounds containing hydrogen or carbon or fluorine, for example $Si_xH_x$, SiC, SiOC.

Formed on the first interface layer 33 (or on the one or more further anti-wetting layers, if present) is a first nozzle layer 35, made for example of epitaxially grown polysilicon, having a thickness comprised between approximately 10 and 75 μm.

The first nozzle layer 35 may be of a material different from polysilicon, for example silicon or some other material still, provided that it may be removed in a selective way in regard to the material of which the first interface layer 33 (or the anti-wetting layer, if present) is made.

Next (FIG. 6A), a photoresist mask (not shown) is deposited on an exposed top surface 35*a* of the first nozzle layer 35 and, by subsequent lithography and etching steps, a through hole 35' is formed through the first nozzle layer 35, until a surface region of the interface layer 33 is exposed. In the case where on the interface layer 33 one or more further anti-wetting layers 33' are present, said further layers are etched and removed in this process step to be self-aligned during complete opening of the nozzle.

Etching is carried out using an etching chemistry capable of removing selectively the material of which the first nozzle layer 35 is made (here, polysilicon), but not the material of which the interface layer 33 is made (here, silicon oxide). The etching profile of the intermediate layer 35 may be controlled by choosing an etching technology and an etching chemistry in order to obtain the desired result.

Figure 6A:
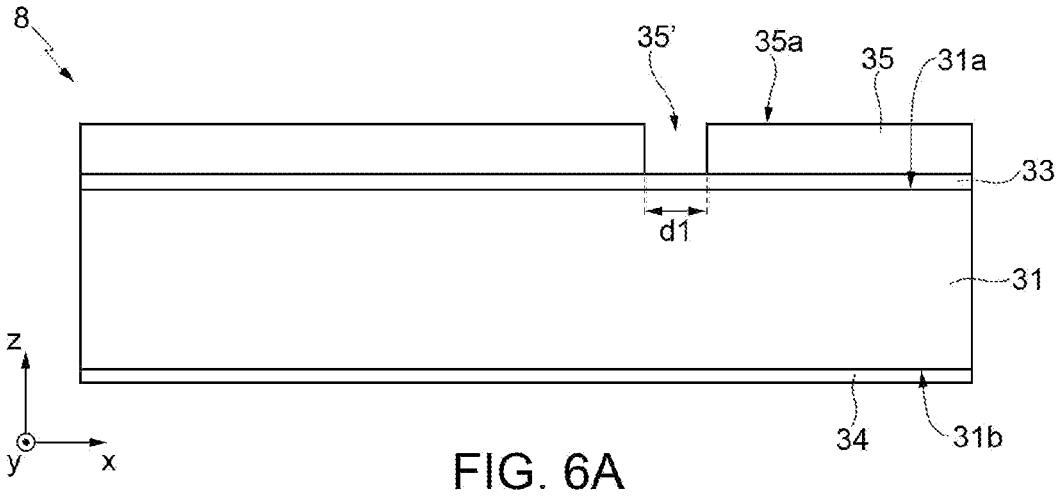

For example, with reference to FIG. 6A, using a dry etch (such as reactive-ion etch (RIE) or deep reactive-ion etch (DRIE)) with standard silicon-etching chemistries normally used in the semiconductor industry ($SF_6$, HBr, etc.) it is possible to obtain a through hole 35' with side walls substantially vertical along Z. The through hole 35' forms in part, in subsequent manufacturing steps, the ejection nozzle of the fluid-ejection device 1. However, as will be described in greater detail with reference to FIG. 7, subsequent manufacturing steps envisage formation of a coating layer (reference number 42 in FIG. 7) on the inner walls of the through hole 35', which thus causes a narrowing thereof.

The coating layer 42 is, in particular, a layer having good characteristics of wettability, for example a silicon-oxide ($SiO_2$). The coating layer 42 is considered to have good characteristics of wettability when it presents a small contact angle with a drop of liquid (typically, water) deposited thereon. The solid-liquid interaction, as is known, may be evaluated in terms of contact angle of a drop of water deposited on the surface considered, measured as angle formed at the surface-liquid interface. A small contact angle is due to the tendency of the drop to flatten out on the surface, and vice versa. In general, a surface having characteristics of wettability such that, when a drop is deposited thereon, the contact angle between the surface and the drop (angle θ) has a value of less than 90°, in particular equal to or less than approximately 40°, is considered a hydrophilic surface. Instead, a surface having characteristics of wettability such that, when a drop is deposited thereon, the contact angle between the surface and the drop (angle θ) has a value greater than 90° is considered a hydrophobic surface.

Consequently, assuming a through hole 35' having a circular shape, in top plan view, the diameter $d_1$ thereof is chosen larger than the desired diameter for the ejection nozzle, according to the thickness envisaged for the coating layer on the inner walls of the through hole 35'.

Figure 6B:
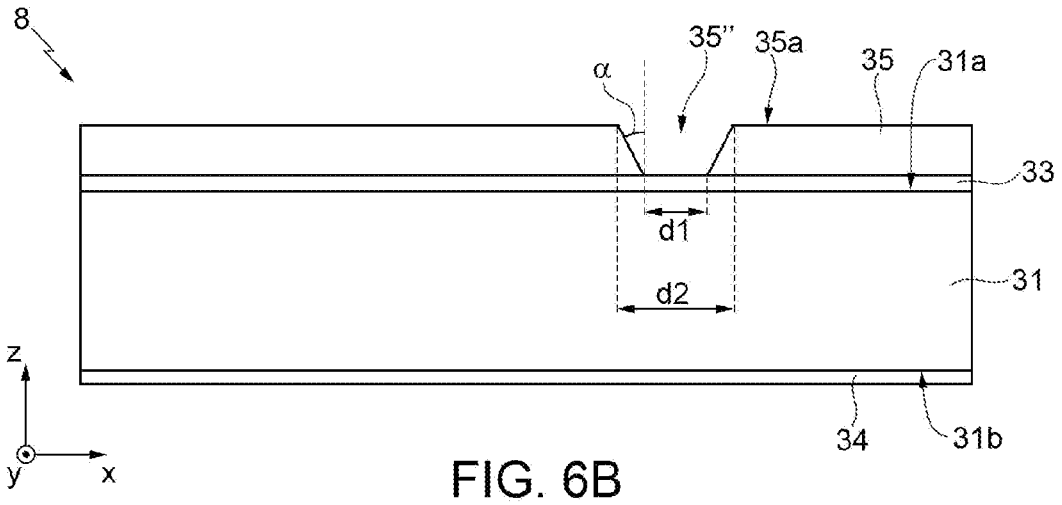
Figure 7:
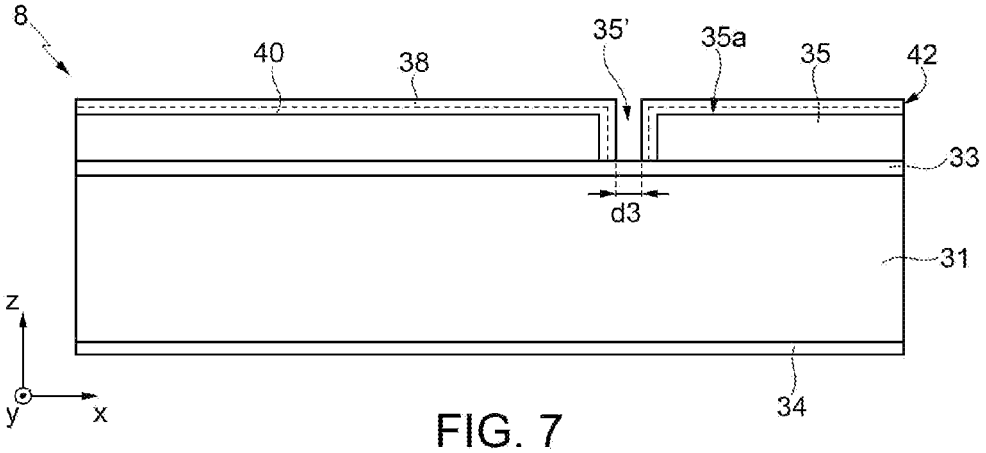
Figure 8:
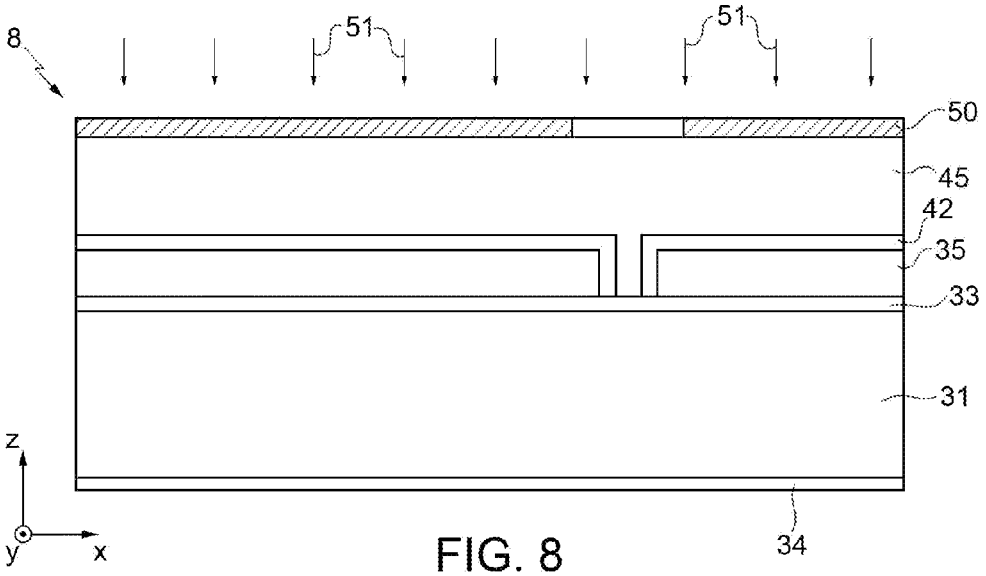

Alternatively, as illustrated in FIG. 6B, using a dry etch (with the etching chemistries referred to above) or a wet etch (with etching chemistry in TMAH or KOH) it is possible to obtain a through hole 35" with inclined side walls, in particular extending, in lateral sectional view, with an angle α of from 0° to 37° with respect to the direction Z. In FIG. 6B, the through hole 35" has a top-base opening (at the top surface 35*a* of the first nozzle layer 35) of a circular shape and with a diameter $d_2$ larger than the diameter $d_1$ of the bottom-base opening (through which the interface layer 33 is exposed); i.e., it extends in the form of a truncated cone. Also in this case, since subsequent manufacturing steps envisage formation of the coating layer (reference number 42 in FIG. 7) on the inner walls of the through hole 35", the base diameters $d_1$ and $d_2$ are reduced. Consequently, assuming a through hole 35" having a circular shape, in top plan view, the base diameters $d_1$ and $d_2$ thereof are chosen larger than the desired value for the ejection nozzle, according to the thickness envisaged for the coating layer on the inner walls of the through hole 35".

After the step of formation of the through hole 35' or 35", according to the respective embodiments, there follows removal of the photoresist mask and, if necessary, a step of cleaning of the top surface 35*a* of the first nozzle layer 35 and of the side walls within the through hole 35', 35". This step, carried out by removal in oxidizing environments at high temperature (>250° C.), and/or in aggressive solvents, has the function of removing undesired polymeric layers that may have formed during the previous etching step.

In what follows, a through hole 35' of the type shown in FIG. 6A, will be described, without thereby this implying any loss of generality. What is described applies, in fact, without any significant variations, also to the wafer processed as shown in FIG. 6B.

Then (FIG. 7), a step of thermal oxidation of the wafer 8 is carried out, for example at a temperature comprised between 800° C. and 1100° C. to form a thermal-oxide layer 38 on the first nozzle layer 35. This step has the function of enabling formation of the thin thermal-oxide layer 38 having a low surface roughness. Instead of using thermal oxidation, the aforesaid oxide may be deposited, entirely or in part, for example using techniques of a CVD type.

The oxide layer 42 extends over the top face of the wafer 8 and within the through hole 35', coating the side walls thereof. The thickness of the oxide layer 42 is between 0.2 μm and 2 μm.

The diameter $d_3$ of the through hole 35' resulting after the step of formation of the oxide layer 42 has a value comprised between 10 μm and 100 μm, for example 20 μm.

Next (FIG. 8), formed on the oxide layer 42 is a second nozzle layer 45, made for example of polysilicon. The second nozzle layer 45 has a final thickness comprised between 80 and 150 μm, for example 100 μm. The second nozzle layer 45 is, for example, grown epitaxially on the oxide layer 42 and within the through hole 35', until a thickness greater than the desired thickness is reached (for example approximately 3-5 μm or more), and is then subjected to a step of CMP (Chemical Mechanical Polishing) to reduce the thickness thereof and obtain an exposed top surface with low roughness.

Figure 9:
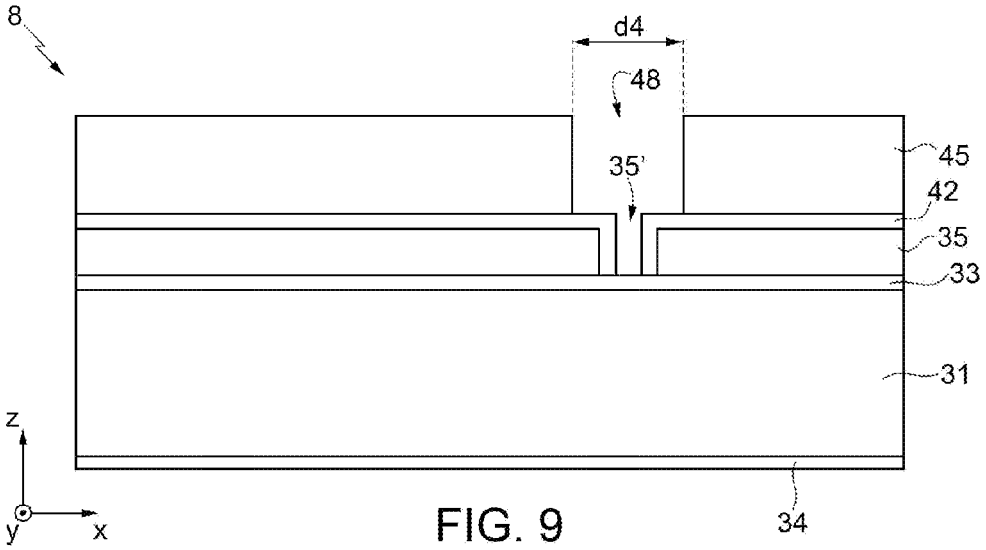

The next step is formation of a feed channel 48 of the nozzle and removal of the polysilicon that, in the previous step, had filled the through hole 35'. For this purpose, an etching mask 50 is laid on the second nozzle layer, and this is followed by a step of etching (indicated by the arrows 51) in the region where the through hole 35' was previously formed. Etching is carried out with an etching chemistry designed to remove the polysilicon with which the second nozzle layer 45 is formed, but not the silicon oxide of the layer 42. Etching proceeds up to complete removal of the polysilicon that extends inside the through hole 35', to form the feed channel 48 through the second nozzle layer 45 in fluid communication with the through opening 35', as illustrated in FIG. 9.

The feed channel 48 has, in top plan view, a diameter $d_4$ greater than the diameter $d_1$; for example, $d_4$ is between 50 μm and 200 μm, in particular 80 μm.

Figure 10:
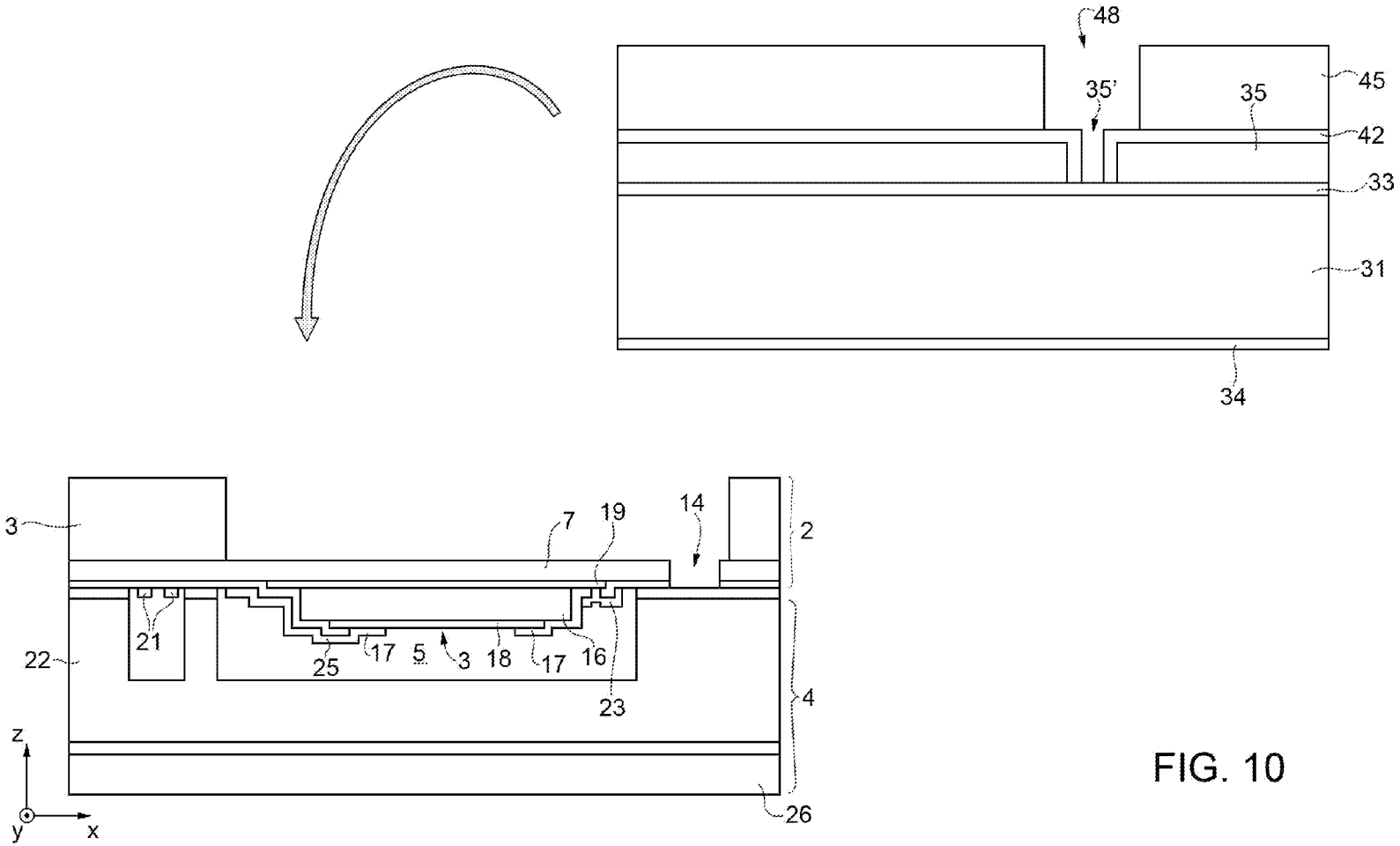
Figure 11:
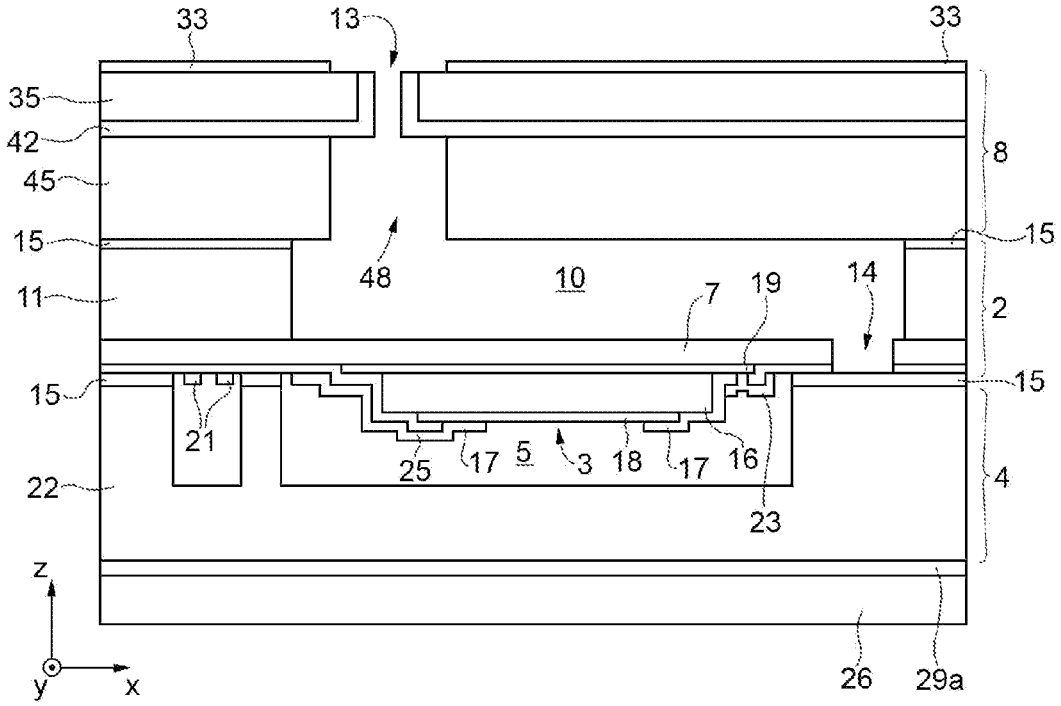

As illustrated in FIG. 10, the stack formed by the first and second wafers 2, 4 is coupled to the third wafer 8, by the wafer-to-wafer bonding technique using adhesive materials for the bonding 15, which may for example be polymeric or else metal or else vitreous.

In particular, the third wafer 8 is coupled to the first wafer 2 so that the feed channel 48 is in fluidic connection with the containment chamber 10.

Then (FIG. 11), a step of removal of the oxide layer 34 and of the exposed substrate 31 is performed. This step may be carried out by grinding the oxide layer 34 and part of the substrate 31, or else with an etching chemistry or else with a combination of these two processes.

Figure 12:
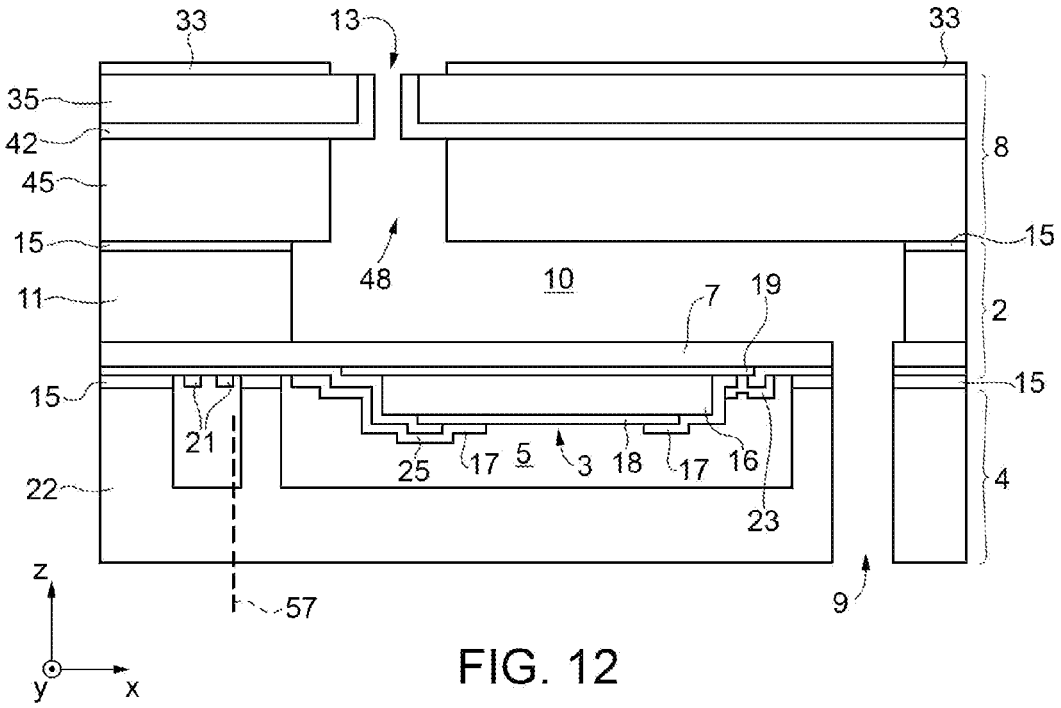

According to the embodiment of FIG. 12, the layer 33 is removed only on the top surface of the layer 35 (in the plane XY), and not along the inner walls of the nozzle 13 (for example, using an etching technique of a dry type, with standard etching chemistry used in semiconductor technologies).

According to one aspect of the present disclosure, the layer 33 is removed on the layer 35 only at the nozzles for outlet of the ink.

What is described applies, in a similar way, also in the case where on the oxide layer 33 (or as an alternative thereto) one or more further anti-wetting layers are present. In this case, however, the step of removal of the structural layer 31 or 33 stops at the anti-wetting layer, which is not removed, or else is removed only along the walls of the nozzle 13 in the case where they are present.

Once again with reference to FIG. 12, there then follows a step of opening of the inlet hole 9 of the second wafer 4 by etching the structural layers 26, 29*a* and 22 using a chemical etch of a dry or wet type (e.g., using an etching chemistry based upon $SF_6$ to remove the polysilicon of the layer 26). Then, the layers 26, 29*a* are completely removed. Alternatively, removal of the layers 26, 29*a* may be performed prior to etching of the layer 22 for formation of the inlet hole 9.

Finally, a step of partial sawing of the second wafer 4, along the scribe line 57 shown in FIG. 12 enables removal of an edge portion of the wafer 4 in areas corresponding to the conductive pads 21 for making them accessible from outside for a subsequent wire-bonding operation. The fluid-ejection device of FIG. 1 is thus obtained.

Figure 13:
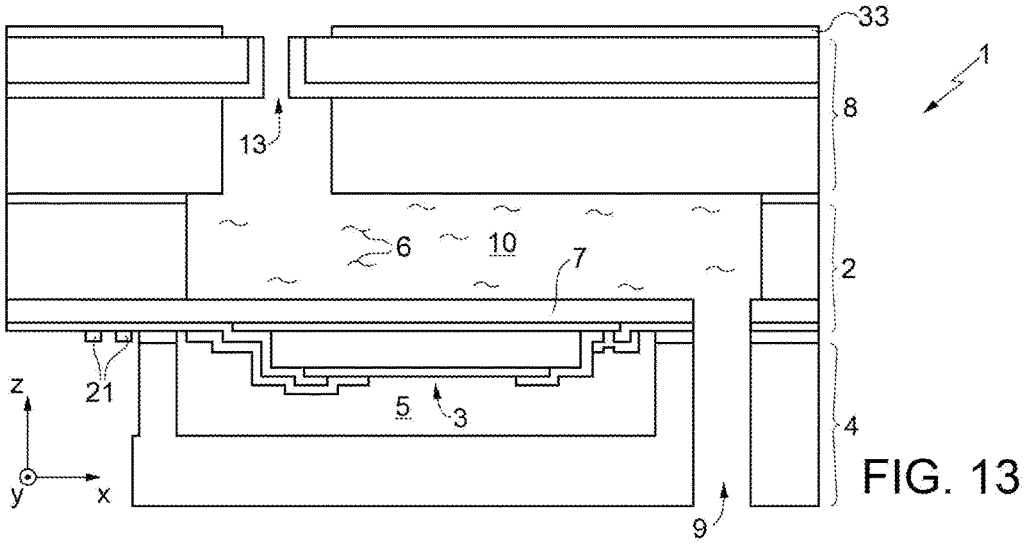
FIGS. 13-15 show the fluid-ejection device manufactured according to the steps of FIGS. 2-12 during respective operating steps.
Figure 14:
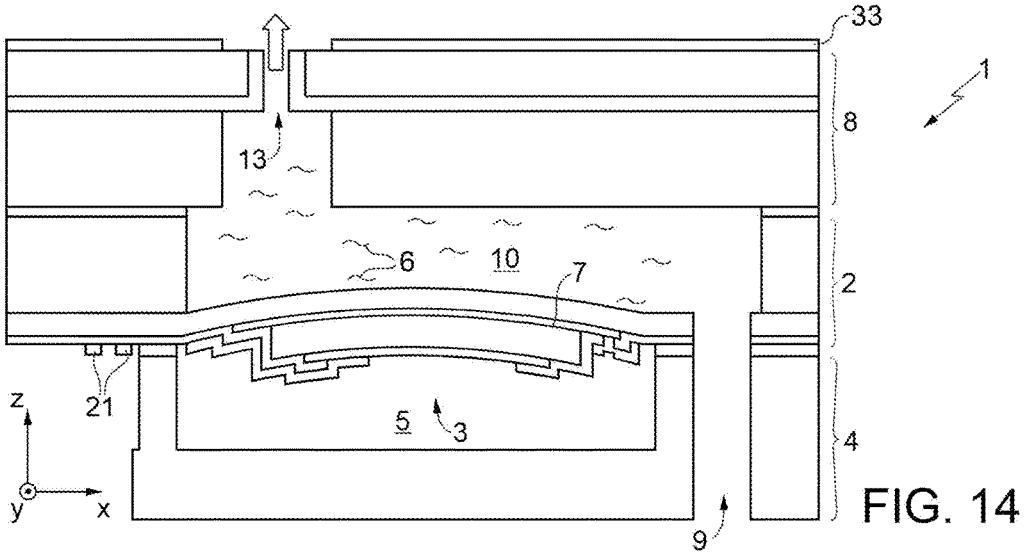
Figure 15:
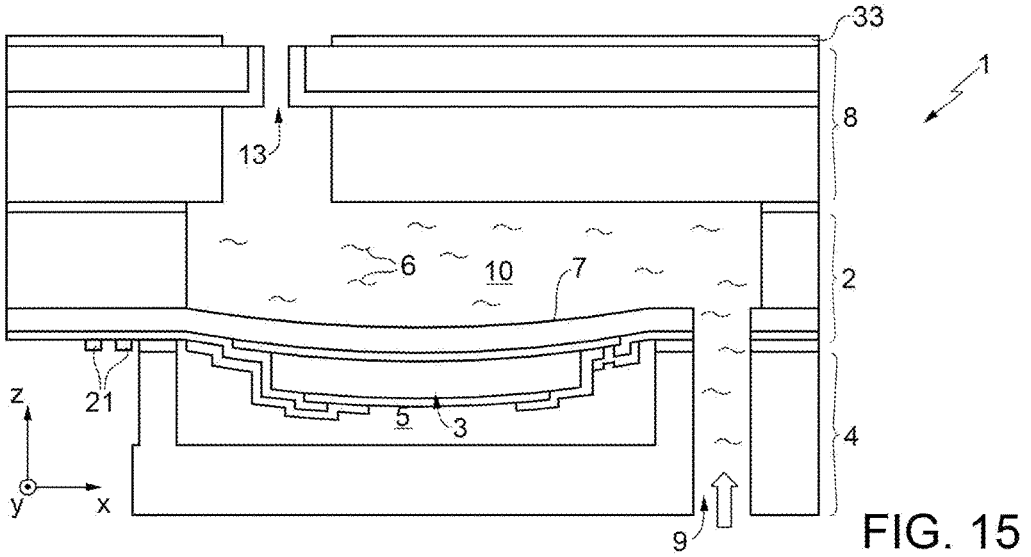

FIGS. 13-15 show the liquid-ejection device 1 in operating steps, during use.

In a first step (FIG. 13), the chamber 10 is filled with a fluid 6 that is to be ejected. Said step of charging of the fluid 6 is carried out through the inlet channel 9.

Then (FIG. 14), the piezoelectric actuator 3 is governed through the top electrode 18 and bottom electrode 19 (biased by the conductive paths 23, 25) for generating a deflection of the membrane 7 towards the inside of the chamber 10. This deflection causes a movement of the fluid 6 through the channel 48, towards the nozzle 13, and generates controlled expulsion of a drop of fluid 6 towards the outside of the fluid-ejection device 1.

Then (FIG. 15), the piezoelectric actuator 3 is governed through the top electrode 18 and bottom electrode 19 for generating a deflection of the membrane 7 in a direction opposite to the one illustrated in FIG. 14 for increasing the volume of the chamber 10, recalling further fluid 6 into the chamber 10 through the inlet channel 9. The chamber 10 is thus recharged with fluid 6. It is then possible to proceed cyclically by operating the piezoelectric actuator 3 for ejection of a further drop of fluid. The steps of FIGS. 14 and 15 are consequently repeated for the entire printing process.

Actuation of the piezoelectric element by biasing the top and bottom electrodes 18, 19 is per se known and not described in detail herein.

From an examination of the characteristics of the disclosure provided according to the present disclosure, the advantages that it affords are evident.

In particular, the steps for manufacture of the nozzle are carried out on the third wafer 8 prior to coupling of the latter to the first wafer 2. This enables use of a wide range of micromachining technologies without the risk of damaging the coupling layers between the first and second wafers 2, 4. In addition, it is possible to form a layer with high wettability (e.g., silicon oxide) within the hole that defines the nozzle 13 in a simple and inexpensive way.

Furthermore, it should be noted that the steps for manufacturing the liquid-ejection device according to the present disclosure do not require coupling of more than three wafers, thus reducing the risks of misalignment in so far as just two steps of coupling the wafers together are performed, thus limiting the manufacturing costs.

Finally, it is clear that modifications and variations may be made to what has been described and illustrated herein, without thereby departing from the scope of the present disclosure.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method, comprising:

manufacturing a device for ejecting a fluid, the manufacturing including:

producing a nozzle plate, including:

forming a first nozzle cavity, having a first diameter, in a first semiconductor body;

forming a first etch-stop layer on the first semiconductor body and on inner walls of said first nozzle cavity;

forming a structural layer on the first etch-stop layer; and etching the structural layer, the etching forming a second nozzle cavity and setting the first and second nozzle cavities in mutual fluidic communication, the second nozzle cavity extending to the first etch-stop layer, being aligned to the first nozzle cavity in a fluid-ejection direction, and having a second diameter larger than the first diameter; and coupling the nozzle plate with a containment chamber adapted to contain said fluid so that the first and second nozzle cavities are in fluidic connection with the containment chamber.

2. The method according to claim 1, wherein forming the first etch-stop layer comprises completely coating the first etch-stop layer on walls of the first nozzle cavity.

3. The method according to claim 1, wherein the first etch-stop layer is of a hydrophilic material.

4. The method according to claim 3, wherein said hydrophilic material has a contact angle equal to or less than 40°.

5. The method according to claim 3, wherein forming the first etch-stop layer comprises thermally growing a first silicon-oxide layer and, then, depositing a second silicon-oxide layer on the thermally grown first silicon-oxide layer.

6. The method according to claim 1, wherein:

the first semiconductor body includes a substrate of semiconductor material, a second etch-stop layer on the substrate, and a nozzle layer on the second etch-stop layer, and forming the first nozzle cavity includes removing selective portions of the nozzle layer until the second etch-stop layer is reached to form a hole having side walls, which extend in said fluid-ejection direction or form an angle with said fluid-ejection direction.

7. The method according to claim 6, wherein the second etch-stop layer is an anti-wetting layer, having a contact angle greater than 90°.

8. The method according to claim 6, further comprising forming one or more anti-wetting layers on the second etch-stop layer, said one or more anti-wetting layers having a contact angle greater than 90°.

9. The method according to claim 6, further comprising:

doping selective portions of the nozzle layer, in a region where the first nozzle cavity is formed, with dopant species containing at least one of hydrogen, fluorine, carbon, phosphorus, and Boron for providing the doped portions with anti-wetting characteristics that include a contact angle greater than 90°; and after forming the first nozzle cavity, removing the substrate and the second etch-stop layer.

10. The method according to claim 1, wherein said nozzle cavity has a cylindrical or frustoconical shape.

11. The method according to claim 1, comprising forming the containment chamber in an actuator plate, wherein forming the containment chamber includes:

forming a membrane layer on a first face of a second semiconductor body;

forming a piezoelectric actuator on the membrane layer; and etching the second semiconductor body on a second face thereof, opposite to the first face in said fluid-ejection direction, thus forming a recess on which the membrane layer is partially suspended, and wherein coupling the nozzle plate to the containment chamber comprises coupling the actuator plate to the nozzle plate at said recess over which the membrane layer is partially suspended.

12. The method according to claim 11, further comprising:

forming, in a third semiconductor body having a first surface and a second surface opposite to one another in said fluid-ejection direction, a first inlet through hole configured to fluidly connect the first and second surfaces of the third semiconductor body with each other;

forming, through said membrane layer, a second inlet through hole;

coupling together the second and third semiconductor bodies so that the first inlet through hole is fluidically connected to the second inlet through hole and, via the second inlet through hole, to the containment chamber.

13. The method according to claim 12, wherein coupling the nozzle plate to the actuator plate comprises forming a bonding layer or a layer of bi-adhesive tape on the nozzle plate and/or on the actuator plate.

14. The method according to claim 1, wherein:

forming the structural layer comprises forming the structural layer in the first nozzle cavity; and etching the structural layer includes removing the structural layer from the first nozzle cavity.

15. A method, comprising:

producing a nozzle plate, including:

forming a first nozzle cavity, having a first diameter, in a first semiconductor body;

forming a first etch-stop layer on the first semiconductor body and on inner walls of said first nozzle cavity;

forming a structural layer on the first etch-stop layer; and etching the structural layer, the etching forming a second nozzle cavity and setting the first and second nozzle cavities in mutual fluidic communication, the second nozzle cavity extending to the first etch-stop layer, being aligned to the first nozzle cavity in a fluid-ejection direction, and having a second diameter larger than the first diameter.

16. The method according to claim 15, wherein forming the structural layer comprises forming the structural layer in the first nozzle cavity and etching the structural layer includes removing the structural layer from the first nozzle cavity.

17. The method according to claim 15, wherein the first etch-stop layer is of a hydrophilic material.

18. The method according to claim 15, wherein:

the first semiconductor body includes a substrate of semiconductor material, a second etch-stop layer on the substrate, and a nozzle layer on the second etch-stop layer, and forming the first nozzle cavity includes removing selective portions of the nozzle layer until the second etch-stop layer is reached to form a hole having side walls, which extend in said fluid-ejection direction or form an angle with said fluid-ejection direction.

19. The method according to claim 18, further comprising:

doping selective portions of the nozzle layer, in a region where the first nozzle cavity is formed, with dopant species containing at least one of hydrogen, fluorine, carbon, phosphorus, and Boron for providing the doped portions with anti-wetting characteristics that include a contact angle greater than 90°; and after forming the first nozzle cavity, removing the substrate and the second etch-stop layer.

20. A method, comprising:

manufacturing a device for ejecting a fluid, the manufacturing including:

producing a nozzle plate in a first semiconductor body;

producing a containment chamber, adapted to contain said fluid, in a second semiconductor body; and affixing the first semiconductor body to the second semiconductor body after producing the nozzle plate in a first semiconductor body and after producing the containment chamber in the second semiconductor body, producing the nozzle plate including:

forming a first nozzle cavity in the first semiconductor body prior to coupling the first semiconductor body to the second semiconductor body;

forming a structural layer on the first semiconductor body and in the first nozzle cavity prior to coupling the first semiconductor body to the second semiconductor body; and forming in the structural layer a second nozzle cavity prior to coupling the first semiconductor body to the second semiconductor body, the second nozzle cavity being aligned to the first nozzle cavity in a fluid-ejection direction and having a second diameter larger than the first diameter, the first and second nozzle cavities being fluidly connected to each other.

21. The method according to claim 20, wherein:

producing the nozzle plate includes forming a first etch-stop layer on the first semiconductor body and on inner walls of said first nozzle cavity;

forming the structural layer includes forming the structural layer on the etch stop layer; and forming the second nozzle cavity includes extending the second nozzle layer to the etch stop layer.

22. The method according to claim 20, wherein producing the containment chamber includes:

forming a membrane layer on a first face of the second semiconductor body;

forming a piezoelectric actuator on the membrane layer; and etching the second semiconductor body on a second face thereof, opposite to the first face in said fluid-ejection direction, thus forming a recess on which the membrane layer is partially suspended.

* * * * *